US009181676B2

(12) United States Patent
Meislahn et al.

(10) Patent No.: US 9,181,676 B2
(45) Date of Patent: Nov. 10, 2015

(54) MACHINE FOOT CONTROL OPERATIONAL PATTERN AND METHOD THEREOF

(71) Applicant: Deere & Company, Moline, IL (US)

(72) Inventors: Scott Meislahn, Dubuque, IA (US); Sean A. Mairet, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 209 days.

(21) Appl. No.: 13/739,035

(22) Filed: Jan. 11, 2013

(65) Prior Publication Data

US 2014/0196558 A1 Jul. 17, 2014

(51) Int. Cl.

| | |
|---|---|
| ***B60K 26/00*** | (2006.01) |
| ***E02F 3/34*** | (2006.01) |
| ***E02F 9/20*** | (2006.01) |

(52) U.S. Cl.

CPC ..... *E02F 3/3414* (2013.01); *E02F 9/2087* (2013.01); *Y10T 74/20201* (2015.01)

(58) Field of Classification Search

USPC ..... 180/315; 701/22, 29, 63, 70

See application file for complete search history.

(56) References Cited

U.S. PATENT DOCUMENTS

| | | | | |
|---|---|---|---|---|
| 5,404,661 | A * | 4/1995 | Sahm et al. | 37/348 |
| 5,470,190 | A * | 11/1995 | Bamford et al. | 414/686 |
| 5,924,516 | A | 7/1999 | Sagaser et al. | |
| 6,132,163 | A | 10/2000 | Andrew et al. | |
| 6,289,783 | B1 | 9/2001 | Sagaser et al. | |
| 2009/0252586 | A1 * | 10/2009 | Sumiyoshi et al. | 414/685 |
| 2012/0003069 | A1 * | 1/2012 | Hagiwara et al. | 414/685 |
| 2012/0293316 | A1 * | 11/2012 | Johnson et al. | 340/438 |
| 2013/0238178 | A1 * | 9/2013 | Young | 701/22 |
| 2014/0186151 | A1 * | 7/2014 | Ootsuka et al. | 414/685 |
| 2014/0271073 | A1 * | 9/2014 | Mueller | 414/685 |
| 2014/0379229 | A1 * | 12/2014 | Walz et al. | 701/50 |
| 2015/0039187 | A1 * | 2/2015 | Friebel | 701/50 |

* cited by examiner

*Primary Examiner* — Toan To

(57) ABSTRACT

The present disclosure provides a foot control pattern for operably controlling an electrohydraulic machine. The machine includes a cab, ground engaging mechanisms, a boom, and a bucket. The foot control pattern includes a machine controller having a plurality of inputs. A first foot control is electrically coupled to a first of the plurality of inputs, where the first foot control is adapted to control the boom. A second foot control is electrically coupled to a second of the plurality of inputs, where the second foot control is adapted to control the bucket. A first hand control is electrically coupled to a third of the plurality of inputs, where the first hand control is adapted to propel and steer the machine.

10 Claims, 5 Drawing Sheets

MACHINE FOOT CONTROL OPERATIONAL PATTERN AND METHOD THEREOF

FIELD OF THE DISCLOSURE

The present disclosure relates to a control system of a work machine, and in particular, to a foot control operational pattern for controlling the machine.

BACKGROUND OF THE DISCLOSURE

Work machines, such as those in the construction and forestry industries, include different control inputs for performing multiple functions. For instance, a machine may include one or more work implements for performing a specific task. The machine may have different controls for performing the specific task. Conventional machines, for example, may include a steering wheel, joystick, foot pedal, push buttons, dials, switches, levers, and the like for controlling the machine. This includes steering the machine as well as using the work implement.

A machine operator is often using two or more of the controls for operating the machine. This requires the operator to be well-trained and cognizant of his or her surroundings. With so many different controls, the operator must operate the machine in a safe manner. Moreover, most machines only have a single operator to control all of the functions thereof. In some instances, the machine operator may be using both hands to control joysticks, levers, etc. Here, if a machine operator wants to adjust throttle, trigger a switch, or readjust a machine setting, the operator would have to release one hand from a joystick or other control to complete the desired task. This can cause the machine to operate at less than optimal performance and with lower productivity. Depending on the circumstances, it may also be inconvenient to the operator to release or stop one machine control in order to change or adjust a second machine control.

A need therefore exists to provide a machine control pattern which offers greater freedom and flexibility to the machine operator to make desired changes to machine control. In addition, there is a need for the machine operator to be able to make changes to machine control instantaneously and without sacrificing machine performance or productivity.

SUMMARY

In an exemplary embodiment of the present disclosure, a foot control pattern is provided for operably controlling an electrohydraulic machine. The machine includes a cab, ground engaging mechanisms, a boom, and a bucket. The foot control pattern includes a machine controller having a plurality of inputs. A first foot control is electrically coupled to a first of the plurality of inputs, where the first foot control is adapted to control the boom. A second foot control is electrically coupled to a second of the plurality of inputs, where the second foot control is adapted to control the bucket. A first hand control is electrically coupled to a third of the plurality of inputs, where the first hand control is adapted to propel and steer the machine.

In one aspect, a second hand control is electrically coupled to a fourth of the plurality of inputs, where the second hand control is operably disabled from performing any machine function. Related thereto, the second hand control is movable in a plurality of directions, where a movement in any one of the plurality of directions does not correspond to any movement of the machine, boom, or bucket. In another aspect, the first foot control is movable in a first direction and a second direction. Here, a movement in the first direction corresponds to a downward movement of the boom and a movement in the second direction corresponds to an upward movement of the boom.

In a different aspect, the second foot control is movable in a first direction and a second direction, where a movement in the first direction corresponds to a downward movement of the bucket and a movement in the second direction corresponds to an upward movement of the bucket. Similarly, the first hand control is movable in at least eight directions, where a movement in a first direction corresponds to a forward movement of the machine, a movement in a second direction corresponds to a reverse movement of the machine, a movement in a third direction corresponds to a clockwise rotation of the machine, and a movement in a fourth direction corresponds to a counterclockwise rotation of the machine.

In another exemplary embodiment, a method is provided for controlling a machine. The machine includes a controller, a first foot control, a second foot control, a first hand control, a second hand control, a boom, a work tool, a control valve electrically coupled to the controller, and a pump electrically coupled to the controller. The method includes the steps of (a) enabling the controller to receive an input signal from only the first foot control, the second foot control, and the first hand control; (b) receiving an input signal from one of the first foot control, the second foot control, and the first hand control, where the input signal corresponds to a desired machine function; (c) sending an output signal to the control valve or pump based on the input signal; and (d) operably controlling the machine in accordance with the output signal.

In one aspect, the method can include determining which of the first foot control, second foot control, and first hand control sent the input signal. Here, the input signal can correspond to a movement of one of the first foot control, the second foot control, and the first hand control in a desired direction. In another aspect, the method can include controllably moving the boom to a down position when the movement of the first foot control is in a first direction and controllably moving the boom to a raised position when the movement of the first foot control is in a second direction. In an alternative aspect, the method can include controllably moving the work tool to a down position when the movement of the second foot control is in a first direction and controllably moving the work tool to a raised position when the movement of the second foot control is in a second direction.

In a different aspect, the method can include the steps of (a) propelling the machine in a forward direction when the movement of the first hand control is in a first direction; (b) propelling the machine in a reverse direction when the movement of the first hand control is in a second direction; (c) steering the machine in a counterclockwise direction when the movement of the first hand control is in a third direction; and (d) steering the machine in a clockwise direction when the movement of the first hand control is in a fourth direction. As such, the first direction is substantially opposite the second direction and the third direction is substantially opposite the fourth direction.

In a further aspect, the method can include the steps of (a) simultaneously propelling the machine in a forward direction and steering the machine in a counterclockwise direction when the movement of the first hand control is in a fifth direction, the fifth direction being angularly disposed between the first direction and third direction; (b) simultaneously propelling the machine in a forward direction and steering the machine in a clockwise direction when the movement of the first hand control is in a sixth direction, the sixth direction being angularly disposed between the first direction and fourth direction; (c) simultaneously propelling the machine in a reverse direction and steering the machine in a clockwise direction when the movement of the first hand control is in a seventh direction, the seventh direction being angularly disposed between the second direction and third direction; and (d) simultaneously propelling the machine in a reverse direction and steering the machine in a counterclockwise direction when the movement of the first hand control is in an eighth direction, the eighth direction being angularly disposed between the second direction and fourth direction. Here, the fifth direction is substantially opposite the eighth direction and the sixth direction is substantially opposite the seventh direction.

In yet another aspect, the method can include sending an electrical signal to the control valve and regulating fluid flow to a first hydraulic cylinder or a second hydraulic cylinder. The first hydraulic cylinder is fluidly coupled to the boom and the second hydraulic cylinder is fluidly coupled to the work tool. The method can also include sending an electrical signal to the pump, regulating fluid pressure and flow to a drive motor, and operably driving a ground-engaging mechanism.

In a different embodiment, a work machine includes a cab, a ground-engaging mechanism for moving the machine along a ground surface, a controller, a boom and a work tool. The work tool is operably coupled to the boom. The machine also includes a control valve electrically coupled to the controller, where the control valve is in fluid communication with the boom and work tool. A pump is electrically coupled to the controller, where the pump is in fluid communication with the ground-engaging mechanism. The machine further includes a first foot control and a second foot control disposed in the cab and being electrically coupled to the controller. Each of the first foot control and second foot control is movable in a first direction and a second direction. Also, a hand control is disposed in the cab and is electrically coupled to the controller. The hand control is movable in at least one of eight different positions, a movement of the first foot control corresponds to a controllable movement of the boom, a movement of the second foot control corresponds to a controllable movement of the work tool, and a movement of the hand control corresponds to a propel or rotational movement of the machine.

In one aspect of this embodiment, a second hand control is disposed in the cab and electrically coupled to the controller, where a movement of the second hand control does not correspond to any function or movement of the machine. In another aspect, a movement of the first foot control in the first direction corresponds to a downward movement of the boom and a movement in the second direction corresponds to an upward movement of the boom. Related thereto, a movement of the second foot control in the first direction corresponds to a downward movement of the work tool and a movement in the second direction corresponds to an upward movement of the work tool. In a different aspect, a movement of the hand control in a first direction corresponds to a forward movement of the machine and a movement of the hand control in a second direction corresponds to a reverse movement of the machine. Moreover, a movement of the hand control in a third direction corresponds to a clockwise rotation of the machine and a movement of the hand control in a fourth direction corresponds to a counterclockwise rotation of the machine.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
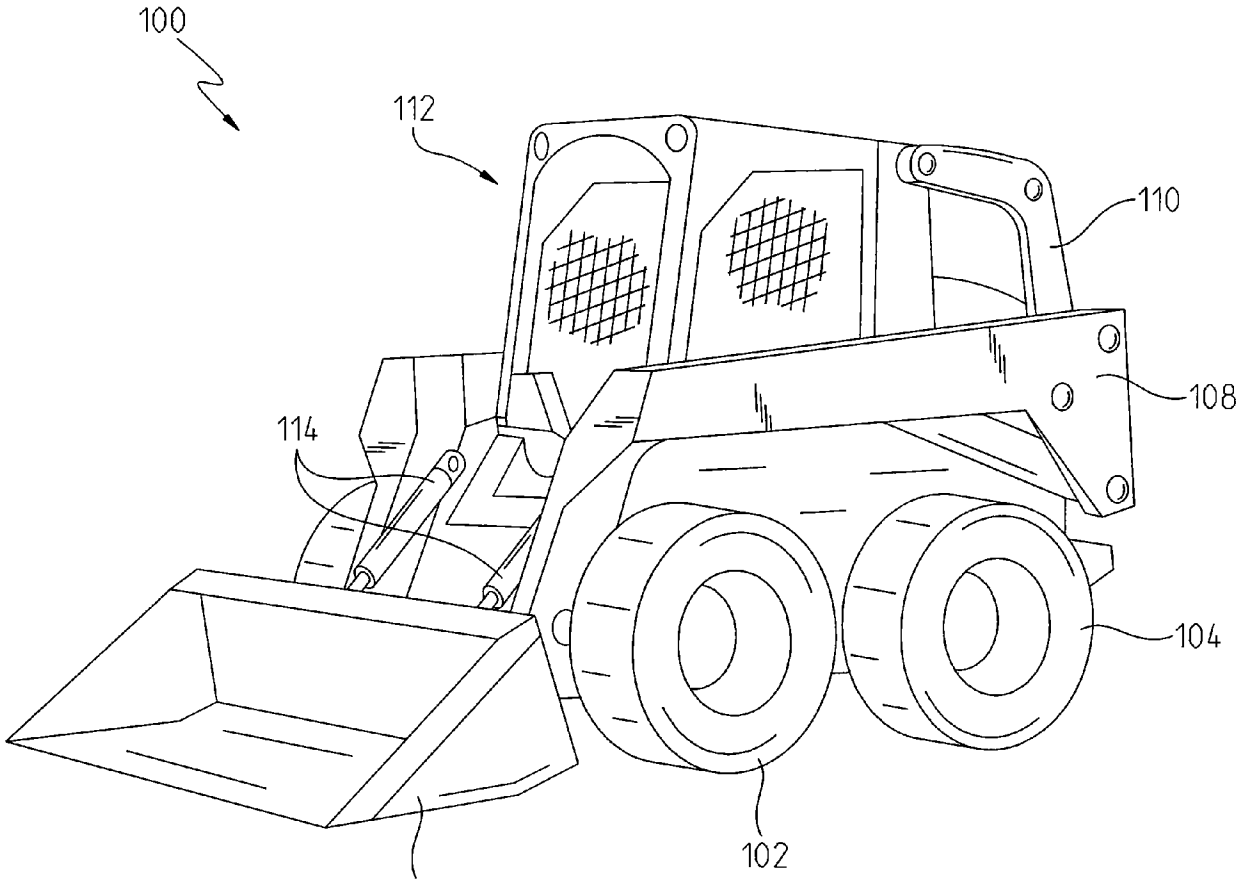
FIG. 1 is a side perspective view of a skid steer loader machine.

Referring to FIG. 1, an exemplary embodiment of a machine, such as a skid steer loader 100, is shown. The skid steer 100 can be provided with a ground-engaging mechanism for moving along the ground. In FIG. 1, the ground-engaging mechanism comprises a pair of front wheels 102 and a pair of rear wheels 104. In another aspect, however, the ground-engaging mechanism can be a drive track disposed on each side of the skid steer 100. In a conventional skid steer, the operator can manipulate controls to drive the wheels on the right or left side of the machine 100 at different speeds to thereby steer the machine 100 in a conventional skid steer fashion. The machine 100 can be further provided with a work tool or loader bucket 106 coupled with a pair of boom arms 108 positioned on each side of the machine 100. The boom arms 108 can be coupled to the machine 100 by a linkage mechanism 110.

The loader bucket 106 is pivotally coupled to a forward portion of the boom arms 108, and a bucket tilt hydraulic cylinder 114 extends between the bucket 106 and the boom arms 108 for controlling the tilted orientation of the bucket 106 with respect to the boom arms 108. By actuating the tilt cylinder 114, the operator can tilt the bucket 106 for dumping the contents therefrom. The boom arms 108 and linkage mechanism 110, which couples the boom arms 108 to the machine 100, can be substantially the same on both the left and right sides of the machine 100. To control the machine 100, boom arms 108 and bucket 106, the machine can include a cab assembly 112 which can have a seat for the machine operator to sit and a plurality of different controls for operating the machine 100.

Figure 2:
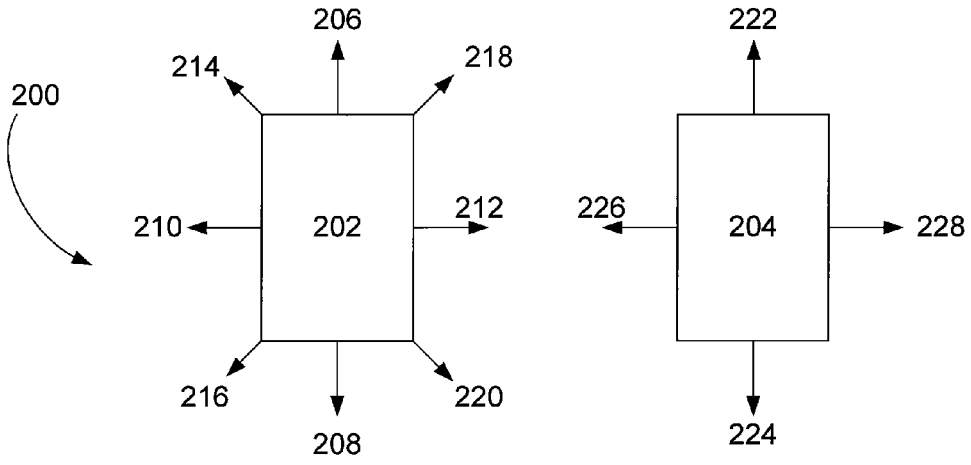
Figure 2 (Prior Art)
FIG. 2 is a schematic of a first conventional control pattern for a work machine.

In conventional control patterns, the machine 100 can be controlled according to the arrangement shown in FIG. 2. In FIG. 2, a first conventional control pattern 200 includes a first joystick 202 and a second joystick 204. The first conventional control pattern 200 can be referred to as a "hand control pattern" since both hands of the operator are required to control the machine 100. The first joystick 202 may be disposed on the leftside of the cab 112 and controlled by an operator's left hand, while the second joystick 204 may be disposed on the rightside of the cab 112 and controlled by the operator's right hand. In this particular pattern 200, the first joystick 202 can operably control the steer and propel functions of the machine 100 and the second joystick 204 can operably control the boom arms 108 and bucket 106.

For instance, the first joystick 202 can control both the steer and propel functions for both of the leftside and rightside of the machine 100. The first joystick 202 can be controlled in a forward direction 206 to propel the machine 100 forward and a reverse direction 208 to propel the machine 100 in reverse. In addition, the machine 100 can be steered in a counterclockwise direction by controllably moving the first joystick 202 in a left direction 210. Similarly, the machine 100 can be steered in a clockwise direction by moving the first joystick 202 in a right direction 212.

The machine 100 can be propelled in a forward direction and turn in a counterclockwise direction by moving the first joystick 202 in a forward-left direction 214. Similarly, the machine 100 can be propelled in a forward direction and turn in a clockwise direction by moving the first joystick 202 in a forward-right direction 218. To propel the machine 100 in reverse and rotate in a counterclockwise direction, the first joystick 202 is moved in a reverse-right direction 220, whereas the machine 100 moves in reverse and rotates clockwise by moving the first joystick 202 in a reverse-right direction 216.

If an operator is controlling the steer and propel functions of the machine 100 via the first joystick 202 with one hand, the operator controls the boom arms 108 and bucket 106 with the other hand. For example, the boom arms 108 can be lowered by moving the second joystick 204 in a forward direction 222. The boom arms 108 can be raised by moving the second joystick 204 in a reverse direction 224. As for the bucket 106, it can be raised to a curl position by moving the second joystick 204 in a left direction 226. If the operator wants to dump the contents from the bucket 106, the operator can do so by moving the second joystick 204 in a right direction 228.

Figure 3:
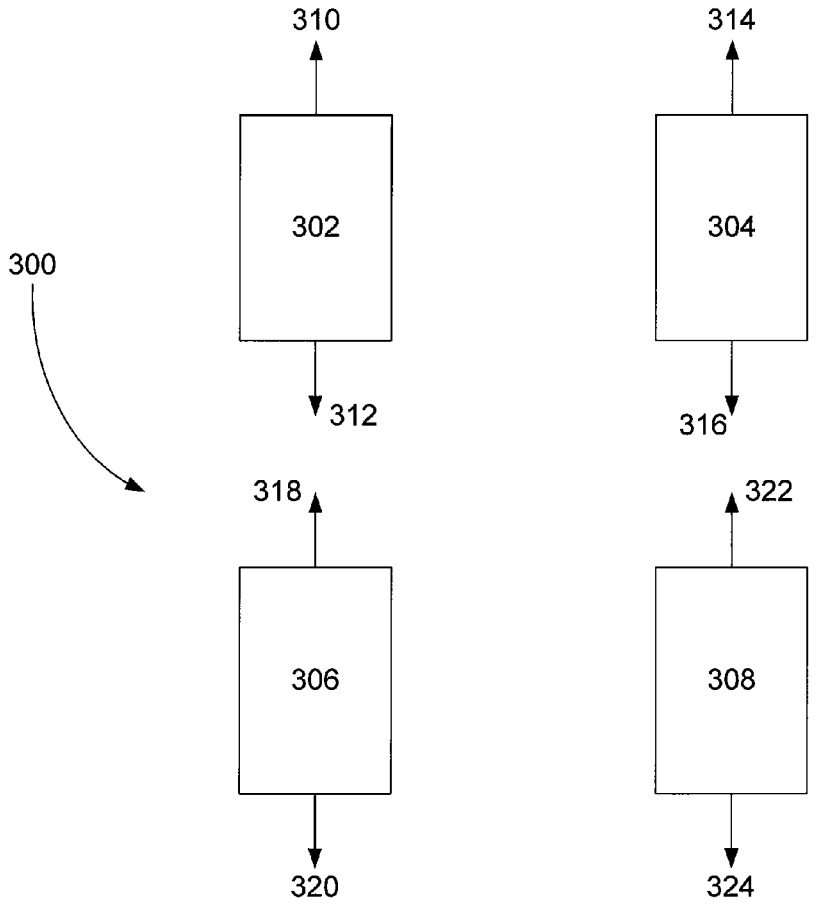
Figure 3 (Prior Art)
FIG. 3 is a schematic of a second conventional control pattern for a work machine.

As previously described, the first conventional pattern 200 requires the operator to use both hands to control the different functions of the machine via the first joystick 202 and second joystick 204. Referring to FIG. 3, a second conventional pattern 300 is provided for controlling the machine 100 and its boom arms 108 and bucket 106. The second conventional control pattern 300 may be referred to as a "foot control pattern" since the operator controls the machine with both hands and feet. Here, the operator is required to use both hands and feet to control the different functions of the machine 100.

In the second conventional pattern 300, the operator controls the steer and propel functions of the machine 100 with a first joystick 306 and a second joystick 308. The first joystick 306 controls the steer and propel functions of the leftside of the machine 100 and the second joystick 308 controls the steer and propel functions of the rightside of the machine 100. The leftside of the machine 100 can be propelled forward by moving the first joystick 306 in a forward direction 318 and the leftside of the machine 100 can be propelled in reverse by moving the first joystick 306 in a reverse direction 320. Similarly, the rightside of the machine 100 can be propelled forward by controlling the second joystick 308 in a forward direction 322. The rightside of the machine 100 can be propelled in reverse by moving the second joystick 308 in a reverse direction 324.

In FIG. 3, the second conventional control pattern 300 also includes a first foot pedal 302 and a second foot pedal 304 for operably controlling the boom arms 108 and bucket 106. For example, the boom arms 108 can be lowered by controllably moving the first foot pedal 302 in a first direction 310, and the boom arms 108 can be raised by moving the first foot pedal 302 in a second direction 312. On the other hand, the bucket 106 can be moved to a dump position by moving the second foot pedal 304 in a first direction 314, whereas the bucket 106 can be raised into a curl position by controlling the second foot pedal 304 in a second direction 316.

In the first conventional control platform 200 and the second conventional control platform 300, the operator is required to use both hands to control different functions of the machine 100. If the operator desires to adjust a machine setting, i.e., change throttle, or perform a different function, the operator would have to release one of the joysticks before the desired task can be completed. In other words, the operator would need a free hand to make the required adjustment, and with both hands controlling the first and second joysticks, the desired task could not be completed until the operator controls and positions the machine 100 such that the operator can safely release one of the joysticks.

Figure 4:
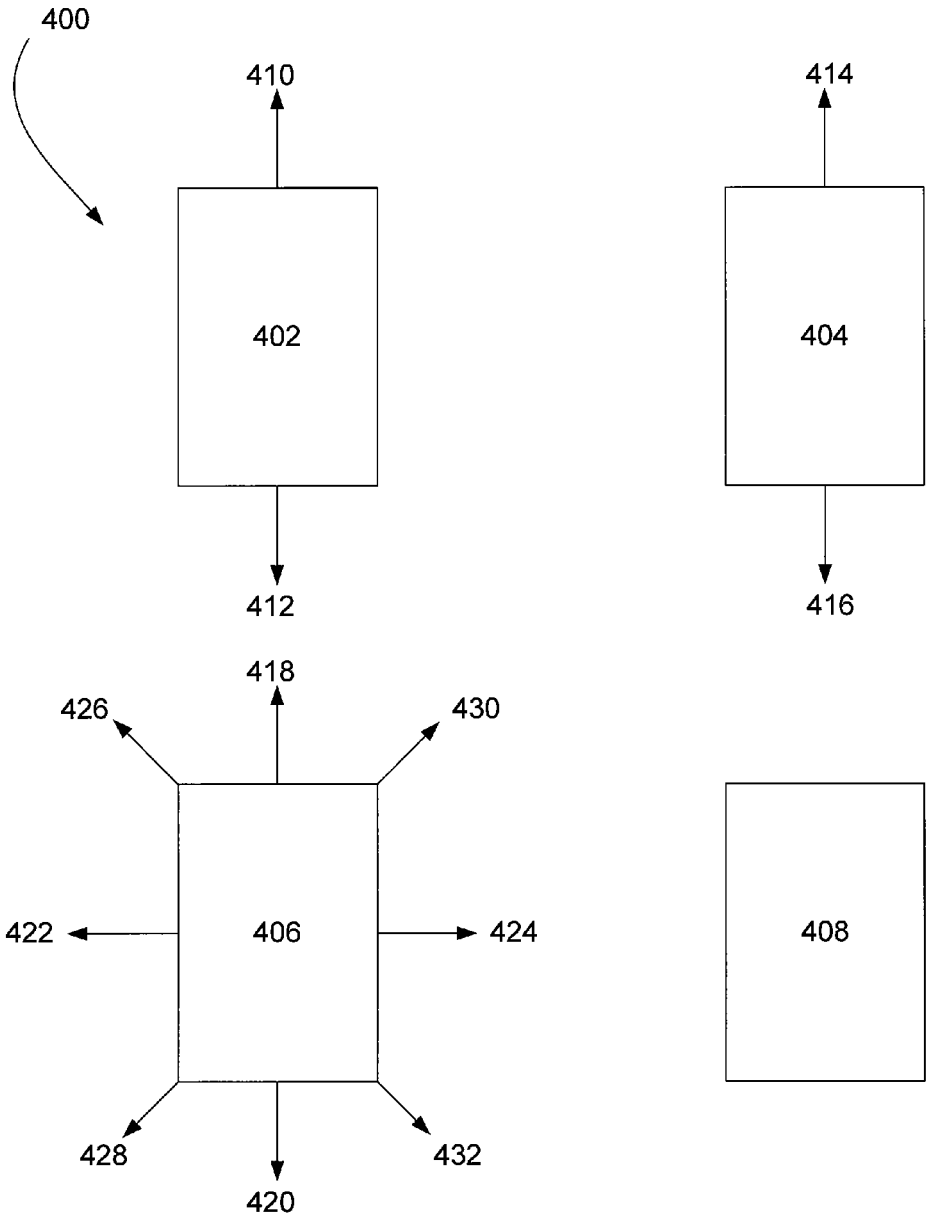
FIG. 4 is a schematic of an improved control pattern for a work machine.
Figure 5:
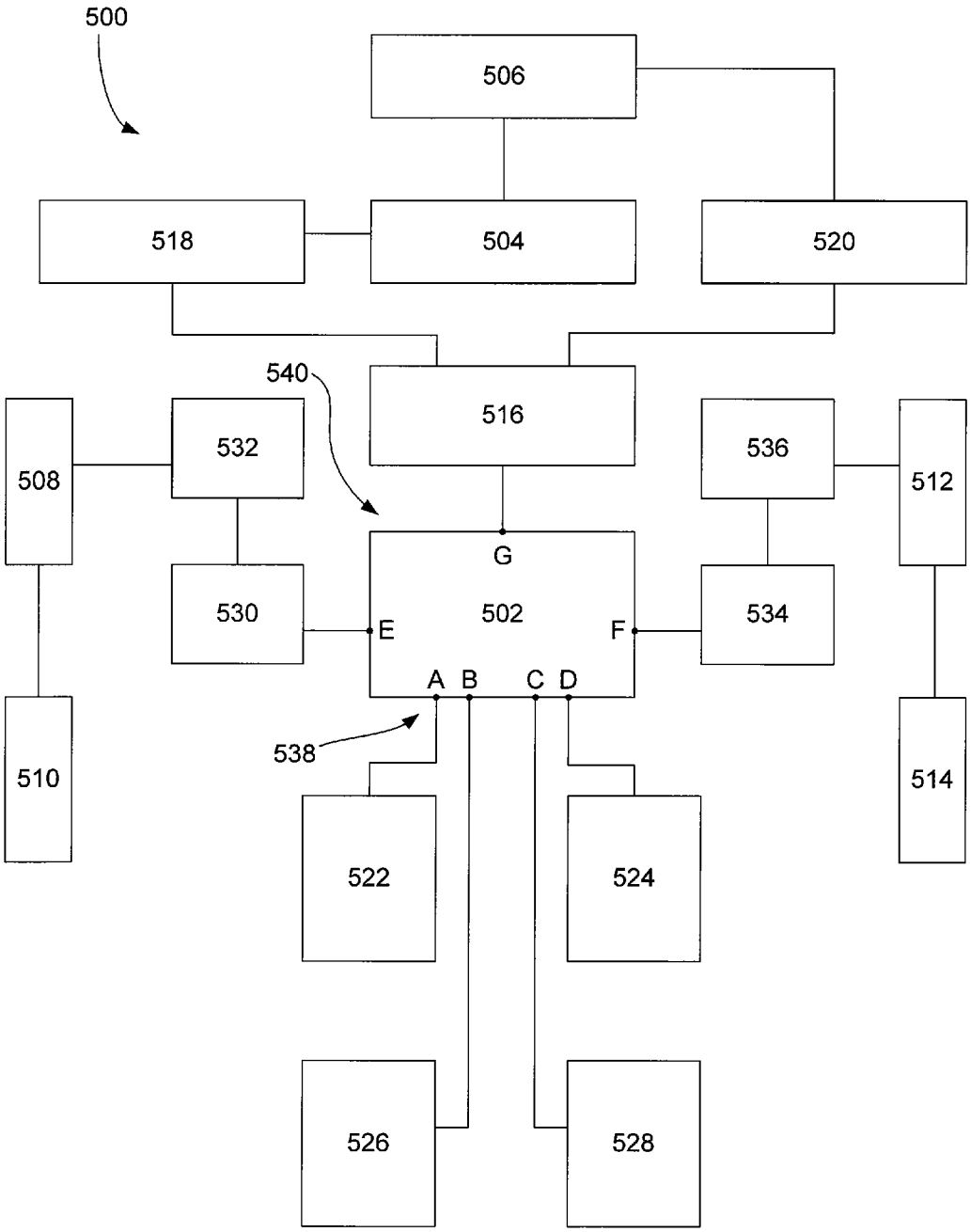
FIG. 5 is a schematic of a control system of the work machine operably controlled via the control pattern of FIG. 4.

Referring to FIGS. 4 and 5, however, a different control system and control platform are provided in the present disclosure that overcomes many of the disadvantages of the conventional platforms previously described. Turning first to FIG. 5, a machine 500 such as a skid steer or other construction or forestry vehicle can include a boom 504 and work tool 506. The work tool 506 can be a bucket, feller head, or other known work implement. The boom 504 can be a single boom or a pair of boom arms as described with reference to FIG. 1. The machine 500 can include a left front wheel 508 and a left rear wheel 510. Similarly, the machine 500 can include a right front wheel 512 and a right rear wheel 514. The front wheels and rear wheels can engage the ground and propel the machine 500 in a desired direction.

The machine 500 can include a main controller 502 that can receive, store, and implement downloadable software for controlling the machine 500. The software can include different algorithms and programs which can be executable by the controller 502. The controller can be electrically coupled to a plurality of operator control inputs 538. Some, if not most, of the plurality of operator control inputs 538 can be disposed in a cab or operator's station of the machine 500. The plurality of operator control inputs 538 can include a first foot control 522, a second foot control 524, a first hand control 526, and a second hand control 528. The first and second foot controls can be foot pedals and the first and second hand controls can be joysticks or levers, for example. The first and second foot controls can be any type of control mechanism in addition to a foot pedal that is disposed in the interior of the cab or operator's station and is operably controlled by an operator's foot. Similarly, the first and second hand controls can be any type of control mechanism in addition to a joystick or lever that is disposed in the interior of the cab or operator's station and can be operably controlled by an operator's hand.

As shown in FIG. 5, the first foot control 522 can be actuated by an operator's foot, and any movement of the first foot control 522 can send an electrical signal to a first input port A of the controller 502. Similarly, the second foot control 524 can send an electrical signal to a fourth input port D of the controller 502. Likewise, the first hand control 526 and second hand control 528 can send electrical signals to a second input port B and a third input port C, respectively, of the controller 502.

The controller 502 can receive these electrical input signals and send corresponding output signals through a plurality of outputs 540. For instance, if the operator desires to propel or steer the machine 500, the controller 502 receives the input signal via the appropriate inputs 538 and then sends an output signal via output port E to a first electrohydraulic pump 530. The first pump 530 is coupled to and can hydraulically drive a first drive motor 532. In turn, the first drive motor 532 can operably power the left front wheel 508 and left rear wheel 510. Similarly, the controller 502 can send an output signal via output port F to a second electrohydraulic pump 534. The second electrohydraulic pump 534 can be coupled to and hydraulically drive a second drive motor 536. The second drive motor 536 therefore can operably power the right front wheel 512 and right rear wheel 514.

In addition, the controller 502 can be electrically coupled to a control valve 516. The control valve 516 can be any type of valve. In one aspect, the valve 516 is an electrohydraulic control valve 516. In this instance, the controller 502 can actuate the control valve 516 by sending an electrical signal via output G. The control valve 516 can be in fluid communication with a first hydraulic cylinder 518 and a second hydraulic cylinder 520. The first hydraulic cylinder 518 can be actuated to control the movement of the boom 504. Moreover, the second hydraulic cylinder 520 can be actuated to control the movement of the work tool 506.

In an alternative aspect, the control valve 516 may be in fluid communication with the first electrohydraulic pump 530 and the second electrohydraulic pump 534. In this manner, the controller 502 receives electrical signals via the plurality of inputs 538 and in turn sends an electrical signal via the output G to the control valve 516. Based on the type of output signal from the controller 502, the control valve 516 can fluidly control the propel and steer functions of the machine 500 and the operation of the boom 504 and work tool 506. In this way, the controller 502 may not be electrically coupled to either the first pump 530 or second pump 534.

The machine 500 can implement a foot control pattern that provides an electrical signal as an input that is converted into a hydraulic output to control the machine 500. In FIG. 4, a foot control pattern 400 for controlling the machine 500 is provided. The foot control pattern 400 can include a plurality of input sources. In FIG. 4, however, only three input sources are necessary for operably controlling the steer, propel, boom 504, and work tool 506 functions of the machine 500. Advantageously, the pattern 400 only requires inputs from a single hand control. Most notably, the pattern 400 may include a first foot control 402, a second foot control 404, a first hand control 406, and a second hand control 408. The first foot control 402 may correspond to the first foot control 522 of FIG. 5. Similarly, the second foot control 404, first hand control 406, and second hand control 408 may correspond with the second foot control 524, first hand control 526, and second hand control 528, respectively.

The first foot control 402 can be operably actuated in a first direction 410 or a second direction 412. In the first direction 410, the first foot control 402 can operably control the boom in a down direction or position. Moreover, the first foot control 402 can operably raise the boom 504 when the control 402 is actuated in the second direction 412. The second foot control 404 can operably control the work tool 506. In the event the work tool 506 is a bucket, the second foot control 404 can be actuated in a first direction 414 to move the bucket towards a dump position or in a second direction 416 to raise the bucket towards a curl position.

Unlike conventional foot control platforms, the first hand control 406 of the foot control platform 400 can operably control both steer and propel functions of the machine 500. Here, the first hand control 406 can be actuated in at least one of eight directions for controlling the movement of the machine 500. For example, the first hand control 406 can be moved in a forward direction 418 to propel the machine 500 forward and in a reverse direction 420 to propel the machine 500 in reverse. The machine 500 can be steered in either a clockwise or counterclockwise direction by controllably moving the first hand control 406 in a left direction 422 (i.e., for counterclockwise rotation) or a right direction 424 (i.e., for clockwise rotation).

The machine can move in a forward direction and turn in a counterclockwise direction (i.e., left) by controllably moving the first hand control 406 in a first direction 426. Alternatively, the machine 500 can move in a forward direction and turn in a clockwise direction (i.e., right) by controllably moving the first hand control 406 in a second direction 430. Similarly, the machine 500 can move in reverse and turn in a clockwise direction (i.e., left) by controllably moving the first hand control 406 in a third direction 428. Likewise, to move the machine 500 in reverse and turn in a counterclockwise direction (i.e., right), the first hand control 406 can be controllably moved in a fourth direction 432.

The foot control pattern 400 does not utilize the second hand control 408 for steer or propel functions, and therefore forms a single hand control operation of an electrohydraulic skid steer or other construction or forestry machine. As a result, the controller 502 does not receive any electrical signal from the second hand control 408, thereby allowing the operator a free hand to adjust machine settings, change throttle, or perform other tasks inside the cab or operator's station. In this manner, the second hand control 408 is disabled and inoperable for purposes of steer, propel, boom, and work tool functionality. As described above, this type of control is not available with conventional foot control patterns which often require both hands to control the steer and propel functions of the machine (or at least one hand to control steer and propel functions and the other hand to control the operation of the boom and work tool). In other aspects, the second hand control 408 may be used for other machine control based on the needs and desires of the machine operator.

Another advantage of the foot control pattern 400 of FIG. 4 is the use of electrohydraulic foot controls which, when actuated, send an electrical signal that is converted into a hydraulic output for controlling the boom 504 and work tool 506. The controller 502 can include executable software downloaded thereto that enables the controller 502 to receive electrical inputs from up to three input sources (i.e., the first foot control 402, the second foot control 404, and the first hand control 406), interpreting said input signals and sending corresponding output signals to the control valve 516 or one of the pumps 530, 534.

The control valve 516, for example, can receive the output signal from the controller 502 and regulate flow to one or both of the hydraulic cylinders 518, 520 for controlling the boom 504 or work tool 506. Similarly, the controller 502 can send output signals to the hydraulic pumps 530, 534, which regulate pressure and flow for controlling the output power provided by one or both of the first drive motor 532 and second drive motor 536. Based on the output power from either drive motor, the machine 500 can be propelled and steered at desired speeds and directions.

In a different aspect, the machine may be a tracked machine rather than a wheeled machine. In FIG. 5, for example, the machine 500 may include a first drive track (not shown) on a left side thereof instead of the left front wheel 508 and left rear wheel 510. Similarly, the machine may include a second drive track (not shown) on a right side thereof instead of the right front wheel 512 and right rear wheel 514. Here, the first drive track (not shown) can be driven by the first drive motor 532 and the second drive track (not shown) can be driven by the second drive motor 536.

Figure 6:
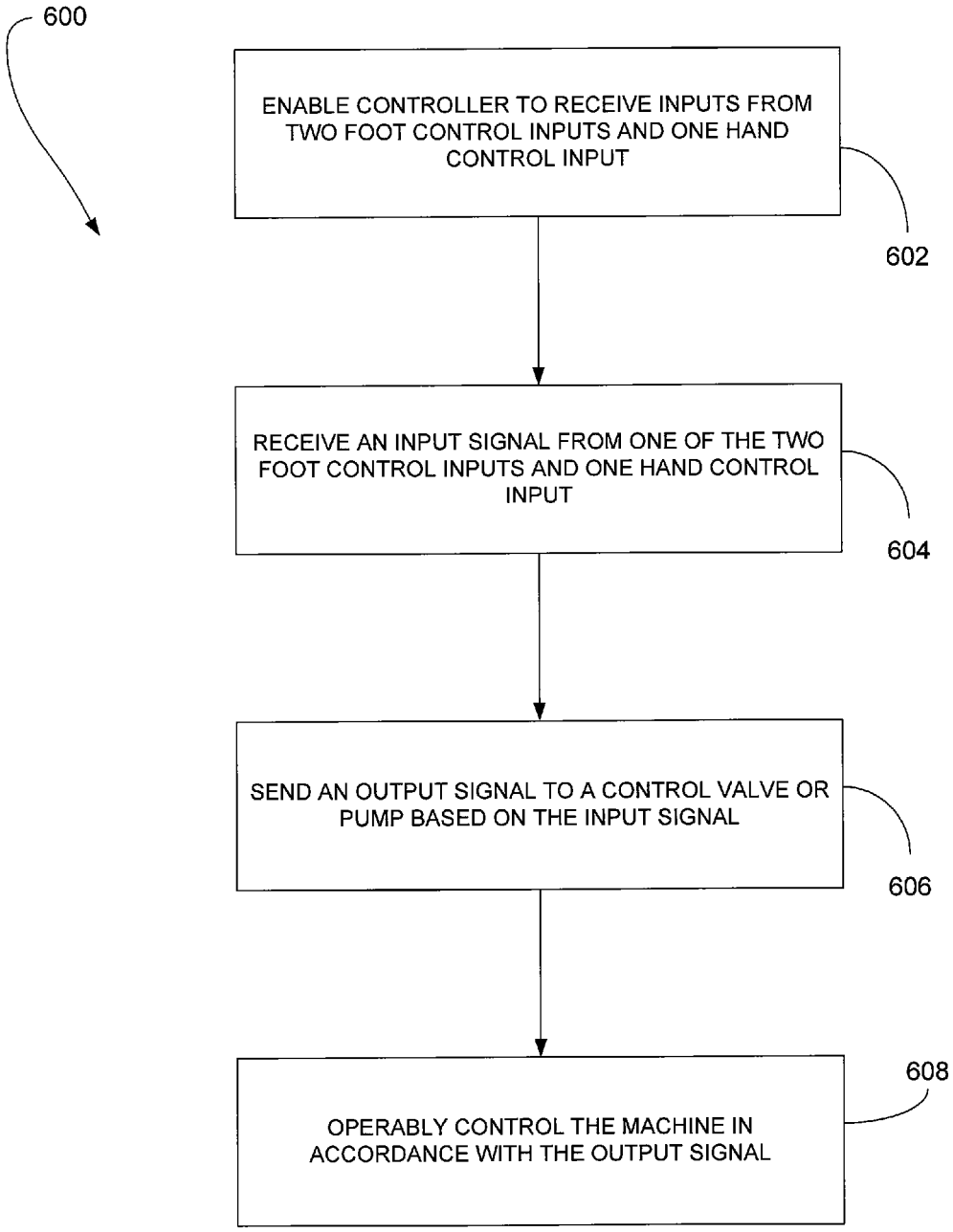
FIG. 6 is a flow diagram of a control method for implementing the control pattern of FIG. 4.

In FIG. 6, an exemplary embodiment is shown of a method for implementing the foot control pattern of FIG. 4. The method 600 can include a plurality of steps, and FIG. 6 is a simplified version that shows only a few of these steps. In step 602, for example, the machine controller 502 is enabled for receiving inputs 538 from at least two foot control inputs and one hand control input. This enables one hand to be free without limiting the performance or productivity of the machine 500.

In accordance with the description related to FIG. 4, an operator can actuate one of the first foot control 402, second foot control 404, or first hand control 406. In doing so, a first input signal is received by the controller in step 604. If the input signal comes from the first foot control 402, the controller can interpret the signal as a desire to operably control the boom 504. On the other hand, if the input signal comes from the second foot control 404, the controller 502 can interpret the signal as a desire to operably control the work tool 506. Moreover, if the input signal is received from the first hand control 406, the controller 502 can interpret the signal as a desire to steer, propel, or both steer and propel the machine 500.

In step 606, the controller 502 can send an output signal to the control valve 516 or pumps 530, 534 based on the input signal. For instance, if the input signal received by the controller 502 from the first hand control 406 corresponds to a movement in the forward direction 418, the controller 502 can send an output signal to the pumps 530, 534 for controlling the drive motors 532, 536 and wheels or drive tracks. Alternatively, if the input signal is from the second foot control 404 and corresponds to a movement in the second direction 416, the controller 502 can send an output signal to the control valve 516 for raising the bucket 506, for example, to a curl position.

In step 608, the machine 500 can be operably controlled in accordance with the output signal sent by the controller 502. This can include controlling machine speed, direction, boom movement, and work tool operation. The control valve 516 can operably control the boom 504 and bucket 506, for example, by regulating flow to the hydraulic cylinders. Moreover, the electrohydraulic pumps 530, 534 can regulate pressure and flow for operably controlling the drive motors 532, 536 and wheels or tracks.

The method 600 of FIG. 6 is limited in the number of steps shown. In a related aspect, the operator has a free hand to control machine throttle or make other adjustments to machine control in an instantaneous fashion without having to release one of the hand controls. Thus, machine performance and productivity can be improved by allowing the operator the freedom to quickly make a machine adjustment, increase or decrease throttle, or use the operator's free hand to complete another task.

While exemplary embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. A foot control pattern for operably controlling an electrohydraulic machine, the machine having a cab, ground engaging mechanisms, a boom, and a bucket, comprising:

a machine controller having a plurality of inputs;

a first foot control electrically coupled to a first of the plurality of inputs, where the first foot control is adapted to control the boom a second foot control electrically coupled to a second of the plurality of inputs, where the second foot control is adapted to control the bucket;

a first hand control electrically coupled to a third of the plurality of inputs, where the first hand control is adapted to propel and steer the machine and where movement of the first hand control corresponds to propel or rotational movement of the machine; and a second hand control electrically coupled to a fourth of the plurality of inputs, where the second hand control is operably disabled for propel, steer, boom, and bucket control.

2. The foot control pattern of claim 1, wherein the second hand control is movable in a plurality of directions, where a movement in any one of the plurality of directions does not correspond to any movement of the machine, boom, or bucket.

3. The foot control pattern of claim 1, wherein the first foot control is movable in a first direction and a second direction;

further wherein, a movement in the first direction corresponds to a downward movement of the boom and a movement in the second direction corresponds to an upward movement of the boom.

4. The foot control pattern of claim 1, wherein the second foot control is movable in a first direction and a second direction;

further wherein, a movement in the first direction corresponds to a downward movement of the bucket and a movement in the second direction corresponds to an upward movement of the bucket.

5. The foot control pattern of claim 1, wherein the first hand control is movable in at least eight directions, where:

a movement in a first direction corresponds to a forward movement of the machine;

a movement in a second direction corresponds to a reverse movement of the machine;

a movement in a third direction corresponds to a clockwise rotation of the machine; and a movement in a fourth direction corresponds to a counterclockwise rotation of the machine.

6. A work machine, comprising:

a cab;

a ground-engaging mechanism for moving the machine along a ground surface;

a boom and a work tool, the work tool being operably coupled to the boom;

a controller;

a control valve electrically coupled to the controller, the control valve being in fluid communication with the boom and work tool;

a pump electrically coupled to the controller, the pump being in fluid communication with the ground-engaging mechanism;

a first foot control and a second foot control disposed in the cab and being electrically coupled to the controller, where each of the first foot control and second foot control is movable in a first direction and a second direction;

a hand control disposed in the cab and being electrically coupled to the controller, the hand control being movable in at least one of eight different directions;

wherein, a movement of the first foot control corresponds to a controllable movement of the boom, a movement of the second foot control corresponds to a controllable movement of the work tool, and a movement of the hand control corresponds to propel or rotational movement of the machine.

7. The work machine of claim 6, further comprising a second hand control disposed in the cab and electrically coupled to the controller, where a movement of the second hand control does not correspond to any function or movement of the machine.

8. The work machine of claim 6, wherein a movement of the first foot control in the first direction corresponds to a downward movement of the boom and a movement in the second direction corresponds to an upward movement of the boom.

9. The work machine of claim 6, wherein a movement of the second foot control in the first direction corresponds to a downward movement of the work tool and a movement in the second direction corresponds to an upward movement of the work tool.

10. The work machine of claim 6, wherein:

a movement of the hand control in a first direction corresponds to a forward movement of the machine;

a movement of the hand control in a second direction corresponds to a reverse movement of the machine;

a movement of the hand control in a third direction corresponds to a clockwise rotation of the machine; and a movement of the hand control in a fourth direction corresponds to a counterclockwise rotation of the machine.

* * * * *